US006776456B1

(12) United States Patent
Tseng

(10) Patent No.: US 6,776,456 B1
(45) Date of Patent: Aug. 17, 2004

(54) GLIDING CHAIR UNIT WITH CUSHIONING MEMBERS

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/611,570

(22) Filed: Jul. 1, 2003

(51) Int. Cl.[7] ..... A47C 15/00
(52) U.S. Cl. ..... 297/246; 297/344.11
(58) Field of Search ..... 297/246, 261.1, 297/344.1, 344.11; 298/430

(56) References Cited

U.S. PATENT DOCUMENTS 742,932 A * 11/1903 Tuttle ..... 297/246
1,956,772 A * 5/1934 Morton ..... 297/246
2,439,632 A * 4/1948 Ramirez ..... 297/246
2,627,895 A * 2/1953 Herman ..... 297/246
3,350,134 A * 10/1967 Kotler ..... 297/246
5,123,701 A * 6/1992 Bottamiller et al. ..... 297/261.1
6,682,142 B1 * 1/2004 Tseng ..... 297/344.11

* cited by examiner

*Primary Examiner*—Peter R Brown
(74) *Attorney, Agent, or Firm*—Ladas & Parry

(57) ABSTRACT

A gliding chair unit includes an upper frame mounted slidably on a base frame. A footrest panel is fixed to the base frame. Left and right cushioning members are respectively mounted on left and right sides of the footrest panel. A gliding mechanism is coupled to the base and upper frames, and includes left and right rails units, each of which includes front and rear rails mounted on the upper frame. When the upper frame moves to a left position, the right cushioning member collides against the front and rear rails of the right rail unit. When the upper frame is moved to a right position, the left cushioning member collides against the front and rear rail of the left rail unit.

5 Claims, 4 Drawing Sheets

GLIDING CHAIR UNIT WITH CUSHIONING MEMBERS

BACKGROUND OF THE INVENTION

1. Field of the Invention

The present invention relates to a gliding chair unit, more particularly to a gliding chair unit with left and right cushioning members.

2. Description of the Related Art

A conventional gliding chair unit generally includes a base frame, an upper frame, and left and right seat members. The base frame includes opposite left and right rods that extend in a longitudinal direction, and opposite front and rear rods that extend in a transverse direction relative to the longitudinal direction and that interconnect the left and right rods. The upper frame is mounted slidably on the base frame, and includes front and rear rods that are respectively disposed on the front and rear rods of the base frame, and left and right rods that extend in the longitudinal direction, that interconnect the front and rear rods of the upper frame, and that are respectively disposed adjacent to the left and right rods of the base frame. The left and right seat members are secured on the upper frame, and are disposed adjacent to the left and right rods of the upper frame, respectively. The upper frame is slidable on the base frame between right and left positions.

The conventional gliding chair unit generates noise and shock during sliding movement of the upper frame relative to the base frame.

SUMMARY OF THE INVENTION

Therefore, the object of this invention is to provide a gliding chair unit having cushioning members that can reduce noise and that can absorb shock during the sliding movement of an upper frame relative to a base frame.

According to the present invention, a gliding chair unit includes: a base frame including opposite left and right rods that extend in a longitudinal direction, and opposite front and rear rods that extend in a transverse direction relative to the longitudinal direction and that interconnect the left and right rods; an upper frame mounted slidably on the base frame, and including front and rear rods that are disposed above and aligned with the front and rear rods of the base frame, respectively, and left and right rods that extend in the longitudinal direction, that interconnect the front and rear rods of the upper frame, and that are respectively disposed adjacent to the left and right rods of the base frame, the upper frame being slidable on the base frame in the transverse direction between a left position, in which the right rod of the upper frame is disposed leftwise of the right rod of the base frame in the transverse direction, and in which the left rod of the upper frame is disposed leftwise of the left rod of the base frame in the transverse direction, and a right position, in which the right rod of the upper frame is disposed rightwise of the right rod of the base frame in the transverse direction, and in which the left rod of the upper frame is disposed rightwise of the left rod of the base frame in the transverse direction; left and right seat members mounted securely on the upper frame and disposed respectively adjacent to the left and right rods of the upper frame; a footrest panel disposed between the left and right seat members, connected securely to the front and rear rods of the base frame, and having left and right sides, each of which has opposite front and rear ends; a cushioning unit including left and right cushioning members, each of which includes a bracket fixed to one of the front and rear ends of a respective one of the left and right sides of the footrest panel and projecting outwardly therefrom in the transverse direction, and a roller that is made from an elastomeric material and that is mounted rotatably on the bracket; and a gliding mechanism disposed between the base frame and the upper frame to permit gliding movement of the upper frame on the base frame between the left and right positions, the gliding mechanism including left and right rail units disposed respectively adjacent to the left and right sides of the footrest panel, and left and right wheel units slidably and respectively engaging the left and right rail units, each of the left and right rail units including curved upper and lower front rails that are respectively formed on the front rods of the base and upper frames and that define a front wheel-receiving space therebetween, and curved upper and lower rear rails that are respectively formed on the rear rods of the base and upper frames and that define a rear wheel-receiving space therebetween which is opposite to the front wheel-receiving space, each of the left and right wheel units including a connecting rod that extends in the longitudinal direction and that has two opposite ends, and a pair of front and rear wheels that are respectively mounted on the opposite ends of the connecting rod, that are respectively received in the front and rear wheel-receiving spaces in a respective one of the left and right rail units, and that slidably and respectively engage the curved upper and lower front rails and the curved upper and lower rear rails of the respective one of the left and right rail units, each of the curved upper front and rear rails having an inner end projecting toward the footrest panel, the roller of the right cushioning member colliding against the inner end of an adjacent one of the curved upper front and rear rails of the right rail unit when the upper frame is moved to the left position, the roller of the left cushioning member colliding against the inner end of an adjacent one of the curved upper front and rear rails of the left rail unit when the upper frame is moved to the right position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
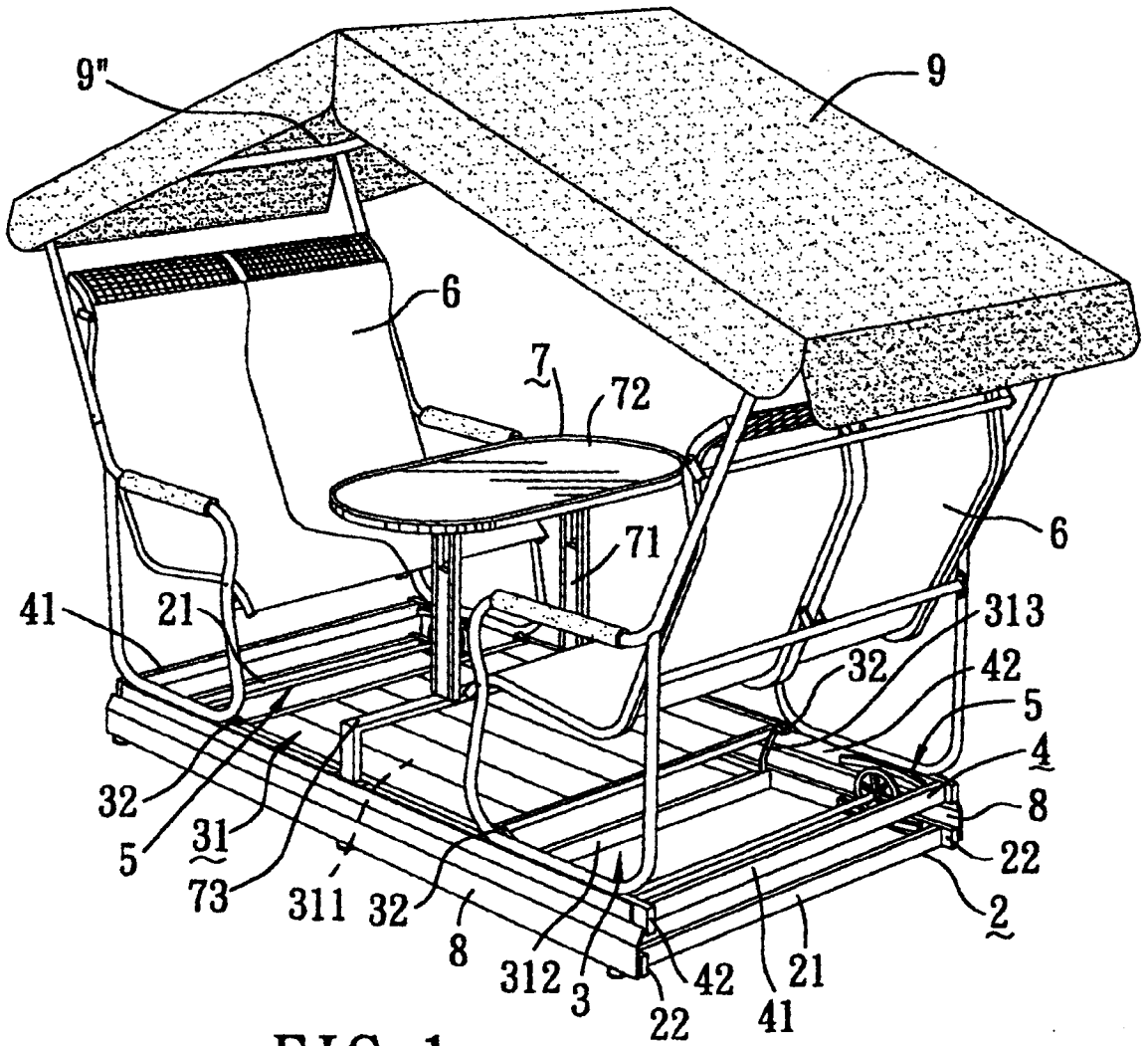
FIG. 1 is a perspective view of the preferred embodiment of a gliding chair unit according to the present invention.
Figure 2:
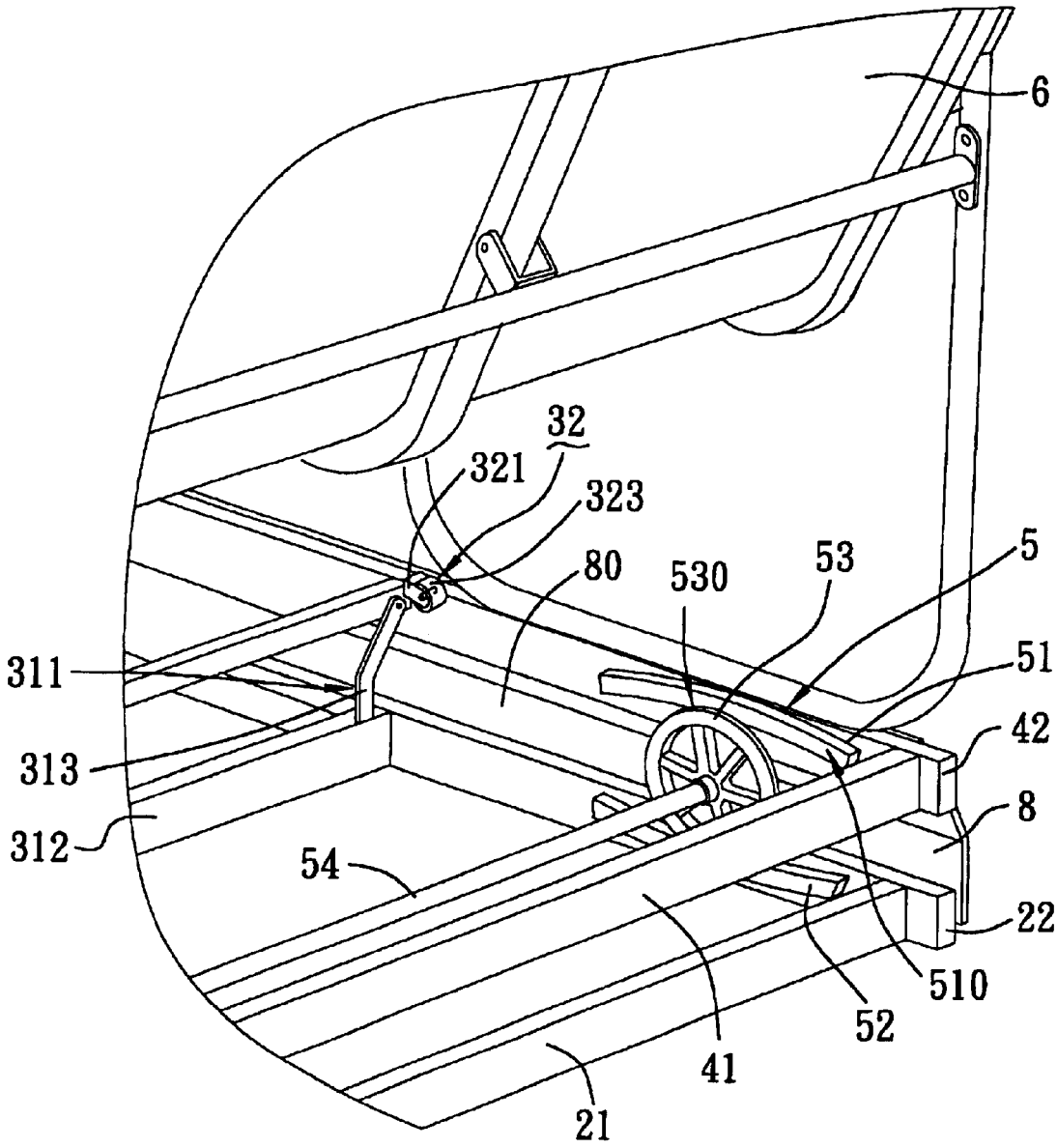
FIG. 2 is a fragmentary perspective view of the preferred embodiment.

Referring to FIGS. 1 and 2, the preferred embodiment of a gliding chair unit according to the present invention is shown to include a base frame 2, an upper frame 4, left and right seat members 6, a footrest panel 31, a cushioning unit, a gliding mechanism 5, and a table 7.

As illustrated, the base frame 2 includes opposite left and right rods 21 that extend in a longitudinal direction, and opposite front and rear rods 22 that extend in a transverse direction relative to the longitudinal direction and that interconnect the left and right rods 21.

Figure 3:
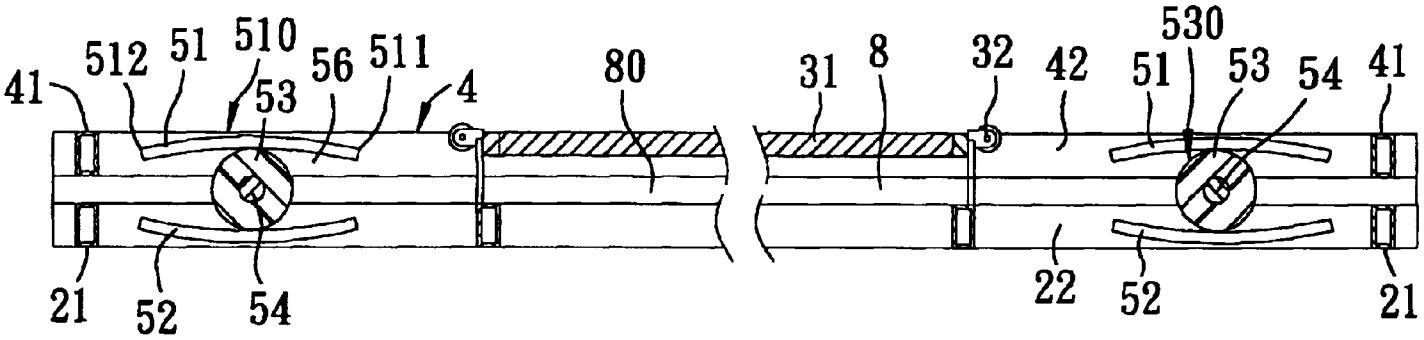
FIG. 3 is a fragmentary, partly sectional side view of the preferred embodiment at a normal position.

The upper frame 4 is mounted slidably on the base frame 2, and includes front and rear rods 42 that are disposed above and aligned with the front and rear rods 22 of the base frame 2, respectively, and left and right rods 41 that extend in the longitudinal direction, that interconnect the front and rear rods 42 of the upper frame 4, and that are respectively disposed adjacent to the left and right rods 21 of the base frame 2. The upper frame 4 is slidable on the base frame 2 in the transverse direction between a left position of FIG. 4, in which the right rod 41 of the upper frame 4 is disposed leftwise of the right rod 21 of the base frame 2 in the transverse direction, and in which the left rod 41 of the upper frame 4 is disposed leftwise of the left rod 21 of the base frame 2 in the transverse direction, and a right position of FIG. 5, in which the right rod 41 of the upper frame 4 is disposed rightwise of the right rod 21 of the base frame 2 in the transverse direction, and in which the left rod 41 of the upper frame 4 is disposed rightwise of the left rod 21 of the base frame 2 in the transverse direction. When the upper frame 4 is disposed at a normal position as shown in FIG. 3, the left and right rods 41 of the upper frame 4 are vertically aligned with the left and right rods 21 of the base frame 2, respectively (see FIG. 3).

The left and right seat members 6 are mounted securely on the upper frame 4, span the front and rear rods 42 of the upper frame 4, and are disposed adjacent to the left and right rods 41, respectively.

The footrest panel 31 is disposed between the left and right seat members 6, is connected securely to the front and rear rods 22 of the base frame 2, and has left and right sides, each of which has opposite front and rear ends.

The cushioning unit includes left and right cushioning members 32, each of which includes a first bracket 321 and a first roller 323. The first bracket 321 of each of the left and right cushioning members 32 is fixed to one of the front and rear ends of a respective one of the left and right sides of the footrest panel 31, and projects outwardly therefrom in the transverse direction. The first roller 323 of each of the left and right cushioning members 32 is made from an elastomeric material, and is mounted rotatably on the first bracket 321. Each of the left and right cushioning members 32 further includes a second bracket 321 and a second roller 323. The second bracket 321 is fixed to the other one of the front and rear ends of the respective one of the left and right sides of the footrest panel 31, and projects outwardly therefrom in the transverse direction. The second roller 323 is also made from an elastomeric material, and is mounted rotatably on the second bracket 321.

Figure 4:
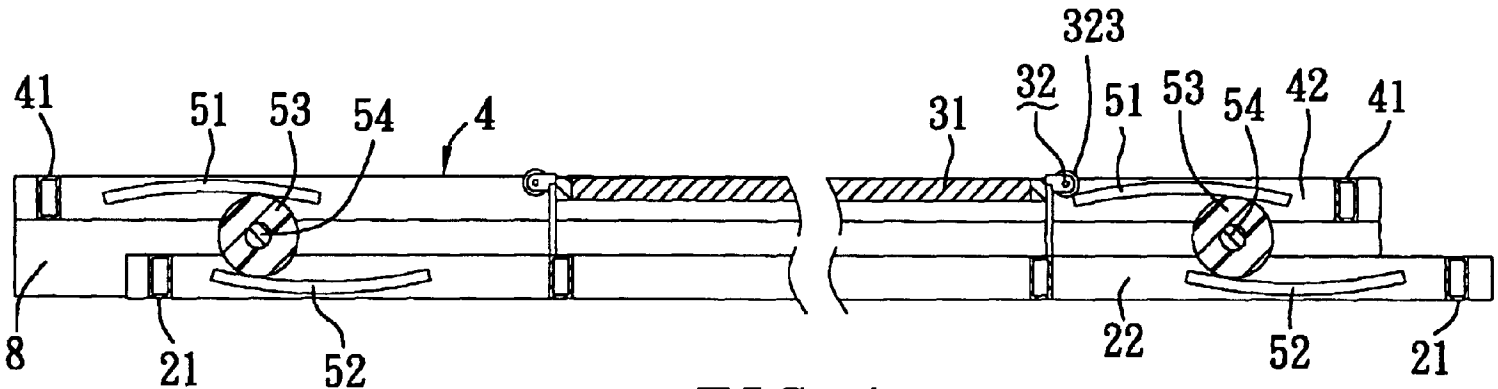
FIG. 4 is a fragmentary, partly sectional side view of the preferred embodiment when an upper frame is at a left position relative to a base frame.
Figure 5:
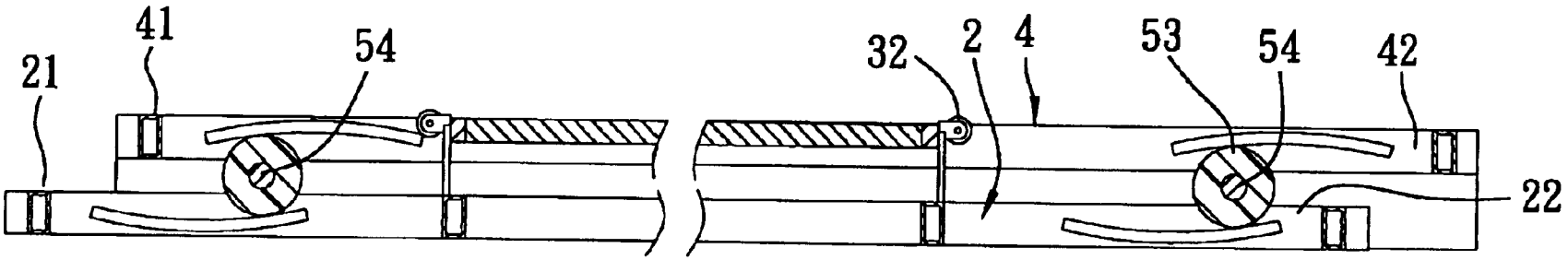
FIG. 5 is a fragmentary, partly sectional side view of the preferred embodiment when the upper frame is at a right position relative to the base frame.

The gliding mechanism 5 is disposed between the base frame 2 and the upper frame 4 to permit gliding movement of the upper frame 4 on the base frame 2 between the left and right positions, and includes left and right rail units 510 and left and right wheel units 530. The left and right rail units 510 are disposed respectively adjacent to the left and right sides of the footrest panel 31. The left and right wheel units 530 slidably and respectively engage the left and right rail units 510. Each of the left and right rail units 510 includes curved upper and lower front rails 51,52 that are respectively formed on the front rods 22,42 of the base and upper frames 2,4 and that define a front wheel-receiving space 56 therebetween, and curved upper and lower rear rails 51,52 that are respectively formed on the rear rods 22,42 of the base and upper frames 2,4 and that define a rear wheel-receiving space 56 therebetween which is opposite to the front wheel-receiving space 56. Each of the left and right wheel units 530 includes a connecting rod 54 that extends in the longitudinal direction and that has two opposite ends, and a pair of front and rear wheels 53 that are respectively mounted on the opposite ends of the connecting rod 54, that are respectively received in the front and rear wheel-receiving spaces 56 in a respective one of the left and right rail units 510, and that slidably and respectively engage the curved upper and lower front rails 51,52 and the curved upper and lower rear rails 51,52 of the respective one of the left and right rail units 510. Each of the curved upper front and rear rails 51 has an inner end 511 projecting toward the footrest panel 31, and an outer end 512 opposite to the inner end 511. When the upper frame 4 is moved to the left position, as shown in FIG. 4, the first and second rollers 323 of the right cushioning member 32 respectively collide against the inner ends 511 of the curved upper front and rear rails 51 of the right rail unit 510, thereby absorbing the shock resulting from the collision. When the upper frame 4 is moved to the right position, as shown in FIG. 5, the first and second rollers 323 of the left cushioning member 32 respectively collide against the inner ends 511 of the curved upper front and rear rails 51 of the left rail unit 510, thereby absorbing the shock resulting from the collision.

The preferred embodiment further includes a panel support 311 disposed below the footrest panel 31. The panel support 311 includes left and right connecting rods 312, left front and rear supporting posts 313, and right front and rear supporting posts 313. The left and right connecting rods 312 are respectively disposed below the left and right sides of the footrest panel 31. Each of the left and right connecting rods 312 extends in the longitudinal direction, and has two opposite ends securely and respectively connected to the front and rear rods 22 of the base frame 2. The left front and rear supporting posts 313 project upwardly and respectively from the two opposite ends of the left connecting rod 312 to connect with the front and rear ends of the left side of the footrest panel 31, respectively. The right front and rear supporting posts 313 project upwardly and respectively from the two opposite ends of the right connecting rod 312 to connect with the front and rear ends of the right side of the footrest panel 31, respectively. Under this condition, the footrest panel 31 is disposed at an elevation above the left and right connecting rods 312 such that the footrest panel 311 is generally flush with the front and rear rods 42 of the upper frame 4. Due to the presence of a front gap 80 between the front rods 42,22 of the upper and base frames 4,2, and a rear gap 80 between the rear rods 42,22 of the upper and base frames 4,2, preferably, elongated front and rear shields 8 are fixed respectively to the front and rear rods 42 of the upper frame 4 and extend downwardly and respectively from the front and rear rods 42 of the upper frame 4 to cover the front and rear gaps 80.

The table 7 includes a U-shaped plate 73 extending in the longitudinal direction and secured to the front and rear rods 42 of the upper frame 4 so as to be disposed at an elevation above the footrest panel 31, left and right legs 71 extending upwardly from the plate 73, and a tabletop 72 fixed on upper ends of the left and right legs 71 such that the tabletop 72 is disposed between the seat members 6.

For shading purposes, a canopy 9 is mounted on a support member 9" which has supporting rods fixed on the left and right seat members 6.

With this invention thus explained, it is apparent that numerous modifications and variations can be made without departing from the scope and spirit of this invention. It is therefore intended that the invention be limited only as indicated in the appended claims.

I claim:

1. A gliding chair unit comprising:

a base frame including opposite left and right rods that extend in a longitudinal direction, and opposite front and rear rods that extend in a transverse direction relative to said longitudinal direction and that interconnect said left and right rods;

an upper frame mounted slidably on said base frame, and including front and rear rods that are disposed above and aligned with said front and rear rods of said base frame, respectively, and left and right rods that extend in said longitudinal direction, that interconnect said front and rear rods of said upper frame, and that are respectively disposed adjacent to said left and right rods of said base frame, said upper frame being slidable on said base frame in said transverse direction between a left position, in which said right rod of said upper frame is disposed leftwise of said right rod of said base frame in said transverse direction and in which said left rod of said upper frame is disposed leftwise of said left rod of said base frame in said transverse direction, and a right position, in which said right rod of said upper frame is disposed rightwise of said right rod of said base frame in said transverse direction, and in which said left rod of said upper frame is disposed rightwise of said left rod of said base frame in said transverse direction;

left and right seat members mounted securely on said upper frame, and disposed adjacent to said left and right rods of said upper frame, respectively;

a footrest panel disposed between said left and right seat members, connected securely to said front and rear rods of said base frame, and having left and right sides, each of which has opposite front and rear ends;

a cushioning unit including left and right cushioning members, each of which includes a first bracket fixed to one of said front and rear ends of a respective one of said left and right sides of said footrest panel and projecting outwardly therefrom in said transverse direction, and a first roller that is made from an elastomeric material and that is mounted rotatably on said first bracket; and a gliding mechanism disposed between said base frame and said upper frame to permit gliding movement of said upper frame on said base frame between said left and right positions, said gliding mechanism including left and right rail units disposed respectively adjacent to said left and right sides of said footrest panel, and left and right wheel units slidably and respectively engaging said left and right rail units, each of said left and right rail units including curved upper and lower front rails that are respectively formed on said front rods of said base and upper frames and that define a front wheel-receiving space therebetween, and curved upper and lower rear rails that are respectively formed on said rear rods of said base and upper frames and that define a rear wheel-receiving space therebetween which is opposite to said front wheel-receiving space, each of said left and right wheel units including a connecting rod that extends in said longitudinal direction and that has two opposite ends, and a pair of front and rear wheels that are respectively mounted on said opposite ends of said connecting rod, that are respectively received in said front and rear wheel-receiving spaces in a respective one of said left and right rail units, and that slidably and respectively engage said curved upper and lower front rails and said curved upper and lower rear rails of the respective one of said left and right rail units, each of said curved upper front and rear rails having an inner end projecting toward said footrest panel, said first roller of said right cushioning member colliding against said inner end of an adjacent one of said curved upper front and rear rails of said right rail unit when said upper frame is moved to said left position, said first roller of said left cushioning member colliding against said inner end of an adjacent one of said curved upper front and rear rails of said left rail unit when said upper frame is moved to said right position.

2. The gliding chair unit as defined in claim 1, wherein each of said left and right cushioning members further includes a second bracket fixed to the other one of said front and rear ends of the respective one of said left and right sides of said footrest panel and projecting outwardly therefrom in said transverse direction, and a second roller that is made from an elastomeric material and that is mounted rotatably on said second bracket.

3. The gliding chair unit as defined in claim 2, further comprising a panel support that is disposed below said footrest panel, and that includes left and right connecting rods respectively disposed below said left and right sides of said footrest panel, left front and rear supporting posts, and right front and rear supporting posts, each of said left and right connecting rods extending in said longitudinal direction, and having two opposite ends securely and respectively connected to said front and rear rod of said base frame, said left front and rear supporting posts projecting upwardly and respectively from said two opposite ends of said left connecting rod to connect respectively with said front and rear ends of said left side of said footrest panel, said right front and rear supporting posts projecting upwardly and respectively from said two opposite ends of said right connecting rod to connect respectively with said front and rear ends of said right side of said footrest panel.

4. The gliding chair unit as defined in claim 1, further comprising a table that is mounted on said front and rear rods of said upper frame between said seat members, and that is disposed at an elevation above said footrest panel.

5. The gliding chair unit as defined in claim 1, further comprising a canopy that is fixed to top ends of said seat members.

* * * * *